United States Patent [19]

Aufdembrink et al.

[11] Patent Number: 4,902,392

[45] Date of Patent: Feb. 20, 1990

[54] HYDROCRACKING PROCESS

[75] Inventors: Brent A. Aufdembrink, Voorhees, N.J.; Thomas F. Degnan, Yardley; Richard F. Socha, Newtown, both of Pa.; Michael R. Stapleton, Pennington, N.J.

[73] Assignee: Mobil Oil Corporation, New York, N.Y.

[21] Appl. No.: 139,545

[22] Filed: Dec. 30, 1987

[51] Int. Cl.[4] ..... C10G 17/00

[52] U.S. Cl. ..... 208/110; 208/108; 208/112; 208/120; 502/242

[58] Field of Search ..... 208/108, 110, 112, 120; 502/242

[56] References Cited

U.S. PATENT DOCUMENTS 4,419,222 12/1983 Corenoble et al. ..... 208/110
4,600,503 7/1986 Angevine et al. ..... 208/251 H
4,650,779 3/1987 Goldstein ..... 502/38
4,686,029 8/1987 Pellet et al. ..... 208/110

*Primary Examiner*—Helane Myers
*Attorney, Agent, or Firm*—Alexander J. McKillop; Charles J. Speciale; Edward F. Kenehan, Jr.

[57] ABSTRACT

A catalytic hydrocracking process for use in refining various petroleum based feedstocks to lighter hydrocarbons. The hydrocracking process for treatment of petroleum fractions utilizes a catalyst comprising (a) a layered metal oxide of the titanometallate type intercalated with an interspathic polymeric chalcogenide, e.g., polymeric silica, (b) a transition hydrogenation metal selected from Group IVA, VIA, and VIIIA of the Periodic Table such as platinum and the like, and optionally, (c) a conventional cracking component, e.g., a large pore crystalline silicate component.

34 Claims, 1 Drawing Sheet

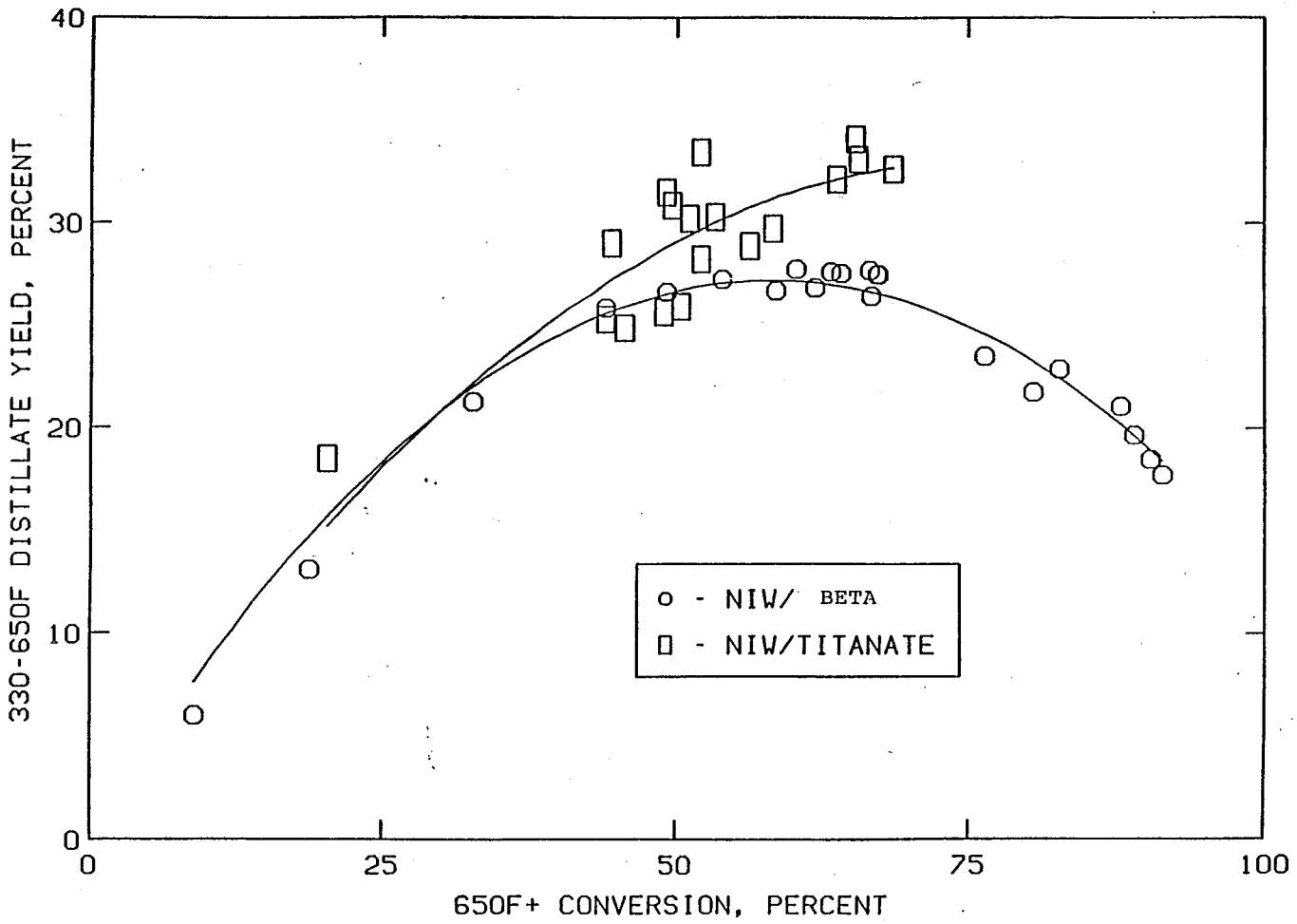
330-650F DISTILLATE YIELD, PERCENT
0
10
20
30
40
0
25
50
75
100
650F+ CONVERSION, PERCENT
o - NIW/ BETA
□ - NIW/TITANATE

HYDROCRACKING PROCESS

This application is related to of a PCT/US/87/01444, filed June 11, 1987, which is a continuation-in-part of U.S. Ser. No. 879,787, filed June 27, 1986, which in turn is a continuation-in-part of U.S. Serial No. 687,414, filed Dec. 28, 1984, now abandoned the entire contents of each are incorporated herein by reference.

The present invention relates generally to a catalytic hydrocracking process for use in refining various petroleum based feedstocks. More particularly, the invention relates to a catalytic hydrocracking process for treatment of petroleum fractions which utilizes a catalyst comprising (a) a layered metal oxide of the titanometallate type intercalated with an interspathic polymeric chalcogenide, e.g., polymeric silica, (b) a transition hydrogenation metal selected from Groups IVA, VIA, and VIIIA of the periodic Table such as platinum and the like, and optionally, (c) a porous crystalline silicate component such as, for example, a large pore zeolite catalyst.

In refining petroleum crude oil to produce desirable products such as gasoline, turbine fuel, diesel fuel and other products known as middle distillates, it is common practice to catalytically hydrocrack high boiling hydrocarbons into hydrocarbon products of lower average molecular weight and boiling point. Feedstocks most often subjected to hydrocracking process are gas oils and heavy gas oils recovered as fractions from crude oil by distillation. Hydrocracking is generally accomplished by contacting, in an appropriate reactor vessel, a gas oil or other hydrocarbon feedstock with a suitable hydrocracking catalyst under appropriate conditions, normally including an elevated temperature and an elevated pressure as well as the presence of hydrogen, such that a hydrocarbon product is obtained containing a substantial proportion of a desired product having a boiling point in a specified range, as for example, a gasoline.

In typical hydrocracking operations, the feedstock is generally contacted with a hydrocracking catalyst which has both an acidic function and a hydrogenation function. In the first step of the hydrocracking reaction, polycyclic aromatics contained within the feedstock are hydrogenated, after which cracking takes place together with further hydrogenation. Depending upon the severity of the reaction conditions, the polycyclic aromatics in the feedstock will be hydrocracked down to paraffinic materials or, under less severe conditions, to monocyclic aromatics as well as paraffins and naphthenes.

The acidic function in the catalysts is provided by a carrier such as alumina, silica-alumina, silica-magnesia or a crystalline zeolite such as faujasite, zeolite X, zeolite Y, mordenite and the like as is well known in the art. Large pore zeolites have proved to be useful catalysts for this purpose because they possess a high degree of intrinsic cracking activity and, for this reason, are capable of producing a good yield of gasoline products.

The hydrogenation function in the hydrocracking catalyst is provided by a metal or combination of metals. Noble metals of Group VIIIA of the Periodic Table (The Periodic Table used in this specification is the table approved by IUPAC and the U.S. National Bureau of Standards), especially platinum or palladium may be used, as may base metals of Groups IVA, VIA and VIIIA, especially chromium, molybdenum, tungsten, cobalt and nickel. Combination of metals, such as nickel-molybdenum, cobalt-molybdenum, cobalt-nickel, nickel-tungsten, cobalt-nickel-molybdenum and nickel-tungsten-titanium have been shown to be effective.

While the above catalysts have been generally satisfactory for their intended use in hydrocracking operations, it has now been found that enhanced hydrocracking can be achieved by utilizing a catalyst containing (a) a layered metal oxide of the titanometallate-type intercalated with an interspathic polymeric chalcogenide, (b) one or more hydrogenation metals selected from a noble metal of Group VIIIA of the Periodic Table and base metals from Groups IVA, VIA and VIIIA, and optionally, (c) a porous cystalline silicate component such as a large pore zeolite material.

More specifically, the titanometallate-type layered metal oxide product comprises a layered metal oxide and pillars of a chalcogenide of at least one element selected from Groups IB, IIB, IIIA, IIIB, IVA, IVB, VA, VB, VIA, VIIA and VIIIA of the Periodic Table of the Elements (Fisher Scientific Co. Cat. No. 5-702-10, 1978) separating the layers of the metal oxide, wherein each layer of the metal oxide has the general formula $$[M_x[\ ]_Y Z_{2-(x+y)}O_4]^{q-}$$

wherein M is at least one metal of valence n wherein n is an integer between 0 and 7 and preferably is 2 or 3, [ ] represents a vacancy site, Z is a tetravalent metal, preferably titanium, and wherein $q=4y-x(n-4)$ and preferably is 0.6–0.9, $O<x+<2$ The metal oxide product contains about 0.5 to about 20 weight percent of said element M, preferably about 1 to 10 weight percent.

The intercalated titanometallate-type layered metal oxide product employed in the present invention comprises layered titanometallate-type layered metal oxide and interspathic polymeric chalcogenide of at least one element, separating the layers of the metal oxide. Preferably, such materials after pillaring are thermally stable, i.e., capable of withstanding calcination at a temperature of about 450° C. for at least 2 hours without significant reduction (e.g., not greater than 10 or 20%) in the spacing between the layers.

It is to be appreciated that the term "layered" metal oxide is used herein in its commonly accepted sense to refer to a material which comprises a plurality of separate metal oxide layers which are capable of being physically displaced away from one another such that the spacing between adjacent layers is increased. Such displacement can be measured by X-ray diffraction techniques and/or by density measurements.

For purposes of the present invention the term "chalcogenide" includes members of the group consisting of oxides, sulfides, selenides, tellurides, and polonides of elements other than those of Group VIB of the Periodic Table of the Elements (Fisher Scientific Co. Cat. No. 5-702-10, 1978). Oxides are particularly preferred as the interspathic polymeric chalcogenide. For present purposes, polymeric chalcogenides are considered to include chalcogenides of two or more repeating units, preferably three or more repeating units, say four or more or even five or more repeating units. The extent of Polymerization of the interspathic polymeric chalcogenide is believed to affect the ultimate interlayer separation of the titanometallate-type layered metal oxide product.

DESCRIPTION OF THE DRAWING

The drawing shows graphically results of hydrocracking by the present process in comparision with a hydrocreating process using NiW/zeolite beta.

In preparing the intercalated layered titanometallate-type layered metal oxide product material used in the catalyst composition, the interlayer separation of the layered titanometallate-type layered metal oxide material can be tailored by careful selection of the "propping" agent used to separate the layers prior to or during treatment with the interspathic polymeric chalcogenide precursors which are eventually converted to the thermally stable polymeric chalcogenide "pillars". Indeed, a wide range of interlayer separations can be achieved in preparing layered materials of the present invention. Interlayer distances can range anywhere from 2 to 30 angstroms or more, say, e.g., greater than 5, 10, 15 or 20 angstroms, depending largely on the type of "propping" agent used as well as the layered chalcogenide being treated. The titanometallate-type layered metal oxide material when intercalated contains an interspathic polymeric chalcogenide of at least one element selected from Groups IB, IIB, IIIA, IIIB, IVA, IV, VA, VB, VIA, VIIA, and VIIIA of the Periodic Table of the Elements (Fisher Scientific Co. Cat. No. 5-702-10, 1978). For example, the intercalated titanometallate-type layered metal oxide can be prepared by treating the titanometallate-type layered metal oxide which contains ion exchange sites having interspathic cations associated therewith, with an organic compound which is a cationic species or capable of forming a cationic species, to effect exchange with said interspathic cations. An electrically neutral compound capable of conversion to the interspathic polymeric chalcogenide is provided between the layers of the treated layered metal oxide. The compound is then converted to the interspathic polymeric chalcogenide to form the intercalated titanometallate-type layered metal oxide product.

The titanometallate-type layered metal oxide starting material contains ion exchange sites having interspathic cations associated therewith. Such interspathic cations may include hydrogen ion, hydronium ion and alkali metal cation. The starting material is treated with a "propping" agent comprising a source of organic cation such as organoammonium, which may include the cation itself, in order to effect an exchange of the interspathic cations resulting in the layers of the starting material being propped apart. Suitable alkylammonium cations can include n-dodecylammonium, n-octylammonium, n-heptylammonium, n-hexylammonium and n-propylammonium. The source of organic cation in those instances where the interspathic cations include hydrogen or hydronium ions may include a neutral compound such as an organic amine which is converted to a cationic analogue during the "propping" treatment. The organic cation should be capable of displacing or supplanting the original interspathic cations. In some instances, it may be desirable to remove excess propping agent which is not electrostatically bound within the layered starting material in order to permit the addition of greater amounts of polymeric chalcogenide precursor. Such removal may be effected by washing out the propping agent with a material which is soluble with said propping agent. The foregoing treatment can result in the formation of a titanometallate-type layered metal oxide of enhanced interlayer separation depending upon the size of the organic cation introduced. Contact of the layered metal oxide with the propping agent may be conducted in aqueous medium so that water is trapped between the layers of the "propped" metal oxide.

After the ion exchange, the organic-"propped" species is treated with a compound capable of forming the above-described polymeric chalcogenide. Preferably, such compounds are capable of forming the polymeric chalcogenide upon hydrolysis or other polymerizing reactions. Hydrolyzable compounds are well-suited as such compounds. It is preferred that the organic cation deposited between the layers is capable of being removed from the layered oxide material without substantial disturbance or removal of the interspathic polymeric chalcogenide. For example, organic cations such as n-octylammonium may be removed by exposure to elevated temperatures, e.g., calcination in nitrogen or air, or chemical oxidation conditions, preferably after the interspathic polymeric chalcogenide precursor has been converted to the polymeric chalcogenide in order to form the layered material product employed in the present invention.

The polymeric chalcogenide precursor-containing product can be exposed to suitable conversion conditions, such as hydrolysis and/or calcination to form the pillared titanometallate-type layered metal oxide material of the present invention. The hydrolysis step may be carried out by any suitable method, for example, by utilizing interspathic water already present in organic-"propped" titanometallate-type layered metal oxide material. Because of the effect of interspathic water on hydrolysis, the extent of hydrolysis may be modified by varying the extent to which the organic-"propped" species is dried prior to addition of the polymeric chalcogenide precursor. As noted earlier, the product after conversion to the polymeric chalcogenide form may be exposed to conditions which remove organic compounds such as the organic cation propping agents, e.g., exposure to elevated temperatures such as those encountered by calcining in air or nitrogen.

In one embodiment the titanometallate-type layered metal oxide, exclusive of its interspathic polymeric chalcogenide, has the empirical formula $$Cs_{4y}([\ ]_yTi_{2-y})O_4$$

The catalyst composition of the present invention generally contains between about 5 to 95, preferably between about 10 to 20, weight percent of said intercalated titanometallate-type layered metal oxide and about 5 to 95, preferably about 80 to 90, weight percent of a large pore porous crystalline silicate material.

In one particular embodiment of a composition for the process of the present invention, the titanometallate-type layered metal oxide has the following additional limitations: $n=3$, M is $Ga^{3+}$, Z is $Ti^{4+}$, $y=0$ and the interspathic polymeric chalcogenide includes polymeric silica. Another embodiment of the present invention uses a layered titanometallate-type layered metal oxide component wherein $n=2$, M is $Zn^{2+}$, Z is $Ti^{4+}$, $y=0$ and said interspathic polymeric chalcogenide comprises polymeric silica.

The titanometallate-type layered metal oxide may comprise about 15 to 40 weight percent of the composition of the present invention while the porous crystalline silicate material may comprise about 60 to 85 weight percent of said composition. The composition may also comprise an inorganic oxide binder, e.g, alumina. Certain titanometallate-type layered metal oxides employed in the present invention are described as well as their method of preparation in U.S. application Ser. No. 879,787, filed June 27, 1986, the entire contents of which are incorporated herein by reference. Such materials are layered titanometallates comprising interspathic polymeric chalcogenide having the general formula $A_x(M_{x/n}Ti_{2-x/n})O_4$, exclusive of the interspathic polymeric chalcogenide, where A is a monovalent cation and n=1 or 2 provided that : where n=1, 0 is less than x is less than 2 and M is a trivalent cation; where n=2, 0 is less than x is less than 4 and M is a divalent cation.

The titanometallate-type layered metal oxides employed in the present invention are described in PCT/US87/01444, filed June 11, 1987. These materials are more broadly defined as a layered product comprising a layered metal oxide and pillars of an oxide of at least one element selected from Groups IB, IIB, IIIA, IIIB, IVA, IVB, VA, VB, VIA, VIIA and VIIIA of the Periodic Table of the Elements (Fisher Scientific Co. Cat. No. 5-702-10, 1978) separating the layers of the metal oxide, wherein each layer of the metal oxide has the general formula:

$$[M_x[\ ]_y Z_{2-(x+y)}O_4]^{q-}$$

wherein M is at least one metal of valence n wherein n is an integer between 0 and 7 and preferably is 2 or 3, [ ] represents a vacancy site, Z is a tetravalent metal, preferably titanium, and wherein $q=4y-x(n-4)$ and preferably is 0.6–0.9, $O<x+y<2$ Preferably, y is greater than zero, more preferably y is greater than 0.1.

The intercalated layered product described in the preceding paragraph can be prepared by a method which comprises the steps of starting with said layered metal oxide and physically separating the layers thereof by introducing an organic cationic species between the layers at anionic sites associated with the layered oxide, introducing between the separated layers of the layered oxide a compound capable of conversion to an oxide and then converting said compound to the oxide to form oxide pillars separating adjacent layers of the layered oxide.

The pillared titanometallate-type layered metal oxide products can have a relatively high interplanar distance (d-spacing), e.g., greater than about 10 angstroms and preferably greater than 20 angstroms up to and even exceeding 30 angstroms. These materials are capable of being exposed to severe conditions such as those encountered in calcining, e.g., at temperatures of about 450° C. for about two or more hours, e.g., four hours, in nitrogen or air, without significant decrease, say, e.g., less than about 10%, in interlayer distance. Furthermore, such pillared oxides can be prepared without the severe dilution often necessary to introduce the interspathic material in prior art techniques of pillaring. Finally, the size of interspathic oxide contained within the final product can be greatly varied because the oxide precursor species is introduced in an electrically neutral form such that the amount of interspathic material incorporated within the titanometallate-type layered metal oxide is not dependent upon the charge density of the original layered oxide. Charge density should be taken into consideration in determining the suitability of the cationic species introduced between the layers in the procedure used to prop open the layers prior to pillaring.

The unpillared titanometallate-type layered metal oxide starting material contains anionic sites having interspathic cations associated therewith. Such interspathic cations may include hydrogen ion, hydronium ion and alkali metal cation.

More specifically, each layer of the titanometallatetype layered metal oxide starting material has the general formula $$[M_x[\ ]_y Z_{2-(x+y)}O_4]^{q-}$$

wherein M is at least one metal of valence n wherein n is an integer between 0 and 7 and preferably is 2 or 3, [ ] represents a vacancy site, Z is a tetravalent metal, preferably titanium, and wherein $q=4y-x(n-4)$ and preferably is 0.6–0.9, $O<x+y<2$ Interposed between the layers of the oxide will be charge-balancing cations A of charge m wherein m is an integer between 1 and 3, preferably 1. Preferably A is a large alkali metal cation selected from the group consisting of Cs, Rb and K and M is a divalent or trivalent metal cation selected from at least one Mg, Sc, Mn, Fe, Cr, Ni, Cu, Zn, In, Ga and Al. For example, M can be both In and Ga. Structurally, these metal oxides are believed to consist of layers of $(M_x[\ ]_yZ_{1-x-y})O_6$ octahedra which are trans edge-shared in one dimension and cis edge-shared in the second dimension forming double octahedral layers which are separated by cations in the third dimension. These materials can be prepared by high temperature fusion of a mixture of (1) metal oxide, (2) alkali metal carbonate or nitrate and (3) tetravalent metal dioxide, e.g., titanium dioxide or by fusion of a mixture of alkali metallate and tetravalent metal dioxide. Such fusion can be carried out in air in ceramic crucibles at temperatures ranging between 600° to 1100° C. after the reagents have been ground to an homogeneous mixture. The resulting product is ground to 20 to 250 mesh prior to the organic swelling and polymeric oxide intercalation steps.

Further description of layered titanometallate starting materials and their methods of preparation can be found in the following references:

Reid, A. F.; Mumme, W. G.; Wadsley, A. D. Acta Cryst. (1968), B24, 1228; Groult, D.; Mercy, C.; Raveau, B. J. Solid State Chem. 1980, 32 289; England, W. A.; Burkett, J. E.; Goodenough, J. B.; Wiseman, P. J. J. Solid State Chem. 1983, 49 300.

Use of these layered metal oxides as the layered starting material permits inclusion of different metal atoms into the layered starting material being treated which allows potential catalytically active sites to be incorporated in the stable layer itself. Moreover, variable amounts of metal atoms may be added to provide a catalyst with optimum activity for a particular process. Furthermore, the infinite trans-edge shared layer structure of the titanometallates-type layered metal oxides instead of the sheared 3-block structure of, for example, $Na_2Ti_3O_7$, may reduce or eliminate shearing of the layers as a possible mechanism for thermal or hydrothermal decomposition of the calcined intercalated material. These titanometallate-type materials may possess even greater thermal stability than silicotitanate molecular sieves. In addition, the variable charge density on the oxide layer possible for these layered metal oxides due to the various oxidation states of metal oxides, the incorporated metal atom and the varying stoichiometry of the materials, may allow variation in the amount of the organic cationic species which can be exchanged into the material. This, in turn, permits variation of the ultimate concentration of the oxide pillars between the layers of the final product.

The titanometallate-type layered metal oxide starting material is initially treated with a "propping" agent comprising a source of organic cation, such as organoammonium cation, in order to effect an exchange of the interspathic cations resulting in the layers of the starting material being propped apart. Suitable organoammonium cations include n-dodecylammonium, n-octylammonium, n-heptylammonium, n-hexylammonium and n-propylammonium. During this propping or swelling step it is important to maintain a low hydrogen ion concentration to prevent decomposition of the titanometallatetype structure as well as to prevent preferential exchange of hydrogen ion over the propping agent. A PH range of 6 to 10, preferably 7 to 8.5 is generally employed during treatment with the propping agent. After this treatment, it has been found advantageous to wash out excess propping agent using a suitable reagent followed by washing with water. For example, n-octylamine is soluble in ethanol and hence ethanol is suitable for use with an n-octylamine propping agent. Such washing permits greater incorporation of the oxide pillar precursor in the layered metal oxide. The water treatment allows penetration of water into the interlayer spaces which assists in subsequent hydrolysis the oxide pillar precursor.

Insertion of the organic cation between the adjoining layers serves to physically separate the layers in such a way as to make the layered material receptive to the interlayer addition of an electrically neutral, hydrolyzable, polymeric oxide precursor. In particular, alkylammonium cations have been found useful in the present invention. Thus $C_3$ and larger alkylammonium, e.g., n-octylammonium, cations are readily incorporated within the interlayer spaces of the layered metal oxide serving to prop open the layers in such a way as to allow incorporation of the polymeric oxide precursor. The extent of the interlayer spacing can be controlled by the size of the organoammonium ion employed so that use of the n-propylammonium cation can achieve an interlayer spacing of 2 to 5 angstroms whereas to achieve an interlayer spacing of 10 to 20 angstroms an n-octylammonium cation or a cation of equivalent length is required. Indeed, the size and shape of the organic cation can affect whether or not it can be incorporated within the layered structure at all. For example, bulky cations such as tetrapropylammonium are generally undesirable for use in the present method while n-alkyl ammonium cations such as those derived from n-alkyl primary amines and $R_3R'N^+$ cations where R is methyl or ethyl and R' is an n-alkyl group with at least 5 carbon atoms, are preferred. Preferably treatment with the organic cationic species is conducted in aqueous media so that water is then available to hydrolyze the electrically neutral, hydrolyzable polymeric chalcogenide precursor subsequently introduced into the "propped" product.

After the ion exchange, the organic-"propped" species is treated with a compound capable of conversion, preferably by hydrolysis, to pillars of an oxide, preferably to a polymeric oxide. Where the treatment involves hydrolysis, this may be carried out using the water already present in organic-"propped" material. In this case, the extent of hydrolysis may be modified by varying the extent to which the organic-"propped" species is dried prior to addition of the polymeric oxide precursor.

It is preferred that the organic cation deposited between the layers be capable of being removed from the pillared material without substantial disturbance or removal of the interspathic polymeric oxide. For example, organic cations such as n-octylammonium may be removed by exposure to elevated temperatures, e.g., calcination, in nitrogen or air, or by chemical oxidation preferably after the interspathic polymeric oxide precursor has been converted to the polymeric oxide pillars in order to form the titanometallate-type layered metal oxide product employed in the present invention.

Interspathic chalcogenide pillars are then formed between the layers of the propped or swollen layered metal oxide starting material and may include a chalcogenide, preferably a polymeric chalcogenide, of zirconium or titanium or more preferably of an element selected from Group IVB of the Periodic Table (Fischer Scientific Company Cat. No. 5-702-10, 1978), other than carbon, i.e., silicon, germanium, tin and lead. Other suitable chalcogenides include those of Group VA, e.g., V, Nb, and Ta, those of Group IIA, e.g., Mg or those of Group IIIB, e.g., B. Most preferably, the pillars include polymeric silica. In addition, the chalcogenide pillars may include an element which provides catalytically active acid sites in the pillars, preferably aluminum.

The chalcogenide pillars are formed from a precursor material which is preferably introduced between the layers of the organic "propped" species as a cationic, or more preferably, electrically neutral, hydrolyzable compound of the desired elements, e.g., those of group IVB. The precursor material is preferably an organometallic compound which is a liquid under ambient conditions. In particular, hydrolyzable compounds, e.g., alkoxides, of the desired elements of the pillars are utilized as the precursors. Suitable polymeric silica precursor materials include tetraalkylsilicates, e.g., tetrapropylorthosilicate, tetramethylorthosilicate and, most preferably, tetraethylorthosilicate. Where the pillars are also required to include a different polymeric metal oxide, e.g., alumina or titania, a hydrolyzable compound of said metal can be contacted with the organic "propped" species before, after or simultaneously with the contacting of the propped titanometallate with the silicon compound. Preferably, the hydrolyzable aluminum compound employed is an aluminum alkoxide, e.g., aluminum isopropoxide. If the pillars are to include titania, a hydrolyzable titanium compound such as titanium alkoxide, e.g., titanium isopropoxide, may be used. In addition, the chalcogenide precursor may contain zeolite precursors such that exposure to conversion conditions results in the formation of interspathic zeolite material as at least part of the chalcogenide pillars. Pillars of polymeric silica and polymeric alumina or polymeric silica and polymeric titania are particularly preferred.

The products of the present invention, especially when calcined, exhibit high surface area, e.g., greater than 200, 300, 400 or even 600 $m^2/g$, and thermal and hydrothermal stability making them highly useful as catalysts or catalytic supports, for hydrocarbon conversion processes for example, cracking and hydrocracking.

After hydrolysis to produce the chalcogenide pillars and calcination to remove the organic propping agent, the final pillared product may contain residual exchangeable cations. Such residual cations in the layered material can be ion exchanged by known methods with other cationic species to Provide or alter the catalytic activity of the pillared product. Suitable replacement cations include cesium, cerium, cobalt, nickel, copper, zinc, manganese, platinum, lanthanum, aluminum, ammonium, hydronium and mixtures thereof.

As was set forth previously, the catalyst for the subject hydrocracking process further includes a hydrogenation metal such as transition metal component selected from the Group VIIIA metals, e.g., the noble metals. Platinum is a particularly preferred metal for the process of the invention. Various combinations of the metals from this group can also be used. Other suitable metals include the base metals of Groups IVA, VIA and VIIIA, particularly chromium, molybdenum, tungsten, cobalt and nickel. Combinations of such metals include nickel-molybdenum, cobalt-molybdenum, cobalt-nickel, nickel-tungsten, cobalt-nickel-molybdenum and nickel-tungstentitanium. The combination of nickel-tungsten is a particularly preferred combination of metals.

As a general rule, the content of the metal component in the catalyst will vary according to its specific catalytic activity, i.e., the highly active metals such as noble metals may be used in smaller amounts than less active metals such as base metals. As to specific amounts, for example, platinum is effective in range of about 0.01 wt percent, preferably about 0.1 wt % up to about 1.0 wt percent. A base metal combination is about 1.0 to about 7 wt. percent nickel and about 2.1 to about 21 wt. percent tungsten is also effective.

In addition to titanometallate-type layered metal oxide materials, the catalyst used in the process of the present invention may optionally include a porous crystalline silicate component, preferably zeolite-type crystalline materials and, most preferably, large pore zeolites having a Constraint Index less than about 2, preferably less than about 1, as described hereinafter. For purposes of this invention, the term "zeolite" is meant to represent the class of porotectosilicates, i.e., porous crystalline silicates, that contain silicon and oxygen atoms as the major components. Other components may be present in minor amounts, usually less than 14 mole %, and preferably less than 4 mole %. These components include aluminum, gallium, iron, boron and the like, with aluminum being preferred, and used herein for illustration purposes. The minor components may be present separately or in mixtures in the catalyst. They may also be present intrinsically in the structure of the catalyst.

The silica-to-alumina mole ratio referred to may be determined by conventional analysis. This ratio is meant to represent, as closely as possible, the ratio in the rigid anionic framework of the zeolite cyrstal and to exclude aluminum in the binder or in cationic or other forms within the channels. Although zeolites with a silica-to-alumina mole ratio of at least 10 are useful, it is preferred to use zeolites having much higher silica-to-alumina mole ratios, i.e., ratios of at least 50:1 or at least 500:1.

A convenient measure of the extent to which a zeolite provides control to molecules of varying sizes to its internal structure is the Constraint Index of the porous crystalline silicate. Porous crystalline silicates which provide a highly restricted access to and egress from its internal structure have a high value for the Constraint Index, and zeolites of this kind usually have pores of small size, e.g. less than 5 angstroms. On the other hand, porous crystalline silicates which provide relatively free access to the internal porous crystalline silicate structure have a low value for the Constraint Index, and usually pores of large size, e.g. greater than 7 angstroms. The method by which Constraint Index is determined is described fully in U.S. Pat. No. 4,016,218, incorporated herein by reference for details of the method.

Constraint Index (CI) values for some typical large pore materials are:

| | CI (at test temperature) |
|---|---|
| ZSM-4 | 0.5 (316° C.) |
| ZSM-12 | 2.3 (316° C.) |
| ZSM-20 | 0.5 (371° C.) |
| ZSM-38 | 2 (510° C.) |
| ZSM-50 | 2.1 (427° C.) |
| TEA Mordenite | 0.4 (316° C.) |
| Mordenite | 0.5 (316° C.) |
| REY | 0.4 (316° C.) |
| Amorphous Silica-alumina | 0.6 (538° C.) |
| Dealuminized Y | 0.5 (510° C.) |
| Zeolite Beta | 0.6–2.0 (316° C.–399° C.) |

The above-described Constraint Index is an important and even critical definition of those porous crystalline silicates which are useful in the instant invention. The very nature of this parameter and the recited technique by which it is determined, however, admit of the possibility that a given porous crystalline silicate can be tested under somewhat different conditions and thereby exhibit different Constraint Indices. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g. temperature, as to establish more than one value for the Constraint Index of a particular porous crystalline silicate. This explains the range of Constraint Indices for some zeolites, such as zeolite beta.

It is to be realized that while the above CI values typically characterize the specified porous crystalline silicates, such values are the cumulative result of several variables useful in the determination and calculation thereof. Thus, for a given zeolite exhibiting a CI value of about 2 or less, depending on the temperature employed during the test method within the range of 290° C to about 538° C, with accompanying conversion between 10% and 60%, the CI may vary. Likewise, other variables such as the crystal size of the porous crystalline silicate, the presence of possibly occluded contaminants and binders intimately combined with the zeolite may affect the CI. It will accordingly be understood to those skilled in the art that the CI, as utilized herein, while affording a highly useful means for characterizing the porous crystalline silicates of interest is approximate, taking into consideration the manner of its determination, with the possibility, in some instances, of compounding variable extremes. However, in all instances, at a temperature within the above-specified range of 290° C. to about 538° C., the CI will have a value for any given porous crystalline silicate of interest herein of about 2 or less, preferably about 1 or less.

The large pore zeolites, i.e., those zeolites having a Constraint Index of about 2 or less, are well known to the art and have a pore size sufficiently large to admit the vast majority of components normally found in a feed chargestock. Such zeolites can have a pore size in excess of 7 angstroms and are represented by zeolites having the structure of, e.g., zeolite beta, Zeolite Y, Zeolite X, Ultrastable Y (USY), Dealuminized Y (Deal Y), REY, L, Faujasite, Mordenite, TEA Mordenite, UHP-Y, ZSM-4, ZSM-12, ZSM-18, ZSM-20, ZSM-50, LZ-210, LZ-210-M, LZ-210-T, and LZ-210-A.

Some of these large pore zeolites are more particularly described in U.S. Pat. Nos. 3,308,069 and Reissue 28,341 (zeolite beta); 3,923,639 (ZSM-4); 3,832,449 (ZSM-12); 3,950,496 (ZSM-18); 3,972,983 (ZSM-20); 4,640,849 (ZSM-50); 3,293,192 and 3,449,070 (USY); 3,442,795 (Deal Y); 4,401,556 (UHP-Y) and 4,534,853 (LZ-210, LZ-210-M, LZ-210-T, and LZ-210A) respectively, the entire contents of which are incorporated by reference.

The feedstock for the subject hydrocracking process may comprise a heavy oil fraction having an initial boiling point of 200° C. (about 400° F.) and normally of 345° C. (about 650° F.) or higher. Suitable feedstocks of this type include gas oils such as vacuum gas oil, coker gas oil, visbreaker oil, deasphalted oil or catalytic cracker cycle oil. Normally, the feedstock will have an extended boiling range such as, for example, 345° C. to 590° C. (about 650° F. to 1100° F.) but may be of more limited ranges with certain feedstocks. The heavy feed will normally contain a substantial amount boiling above 230° C. (450° F.) and will normally have an initial boiling point of at least about 290° C. (about 550° F.), more usually about 345° C. (about 650° F.). Typical boiling ranges will be about 345° to 565° C. (about 650° F. to 1050° F.). The subject process is particularly effective in hydrocracking vacuum gas oils and deasphalted resids.

In the process, the feedstock is heated to an elevated temperature and is then passed over the hydrocracking catalyst in the presence of hydrogen. Because the hydrocracking reaction is net exothermic, the feedstock need not be preheated to the temperature desired in the catalyst reactor bed. Feed inlet temperatures normally in the range 360° C. to 440° C. (about 675° F. to 825° F.) are typical. At the beginning of the process cycle, the temperature employed will be at the lower end of this range but as the catalyst ages, the temperature may be increased in order to maintain the desired degree of catalyst activity.

As was mentioned, the heavy oil feedstock is passed over the catalyst in the presence of hydrogen. The space velocity of the oil feedstock is usually in the range of 0.1 to 10 LHSV, preferably 0.2 to 2.0 LHSV and the hydrogen circulation rate from 250 to 1000 $n.l.l^{-1}$ (about 1400 to 5600 SCF/bbl) and more usually from 300 to 800 $n.l.l^{-1}$ (about 1685 to 4500 SCF/bbl). Hydrogen partial pressure is usually at least 75 percent of the total system pressure with reactor inlet pressures normally being in the range of 3000 to 15,000 kPa (about 420 to about 2160 psig), more commonly from 5,000 to 10,000 kPa (about 710 to 1435 psig). Higher pressure operations, typically up to 30,000 kPa (about 4335 psig), may also be used. A preferred mode of operation is with low to moderate pressures, typically from 5,000 to 15,000 kPa (2160 psig). The process may be operated at low conversion levels, such an operation, the pressure may be considerably lower than normal according to conventional practices, e.g., pressures of 5,000 to 7,000 kPa (710 to 1000 psig) may be satisfactory, as compared to the pressure of at least 10,500 kPa (about 1500 psig) normally used in commercial hydrocracking processes. However, if desired, low conversion may be obtained by suitable selection of other reaction parameters, e.g., temperature, space velocity, choice of catalyst, even lower pressures may be used. Low pressures are advantageous from the point of view of equipment design since less massive and consequently less expensive equipment will be adequate.

The metal component can be exchanged into the metal oxide catalyst and/or into the zeolite portion, if present, or alternatively, can be impregnated or physically admixed with the various catalyst components. If the metal is to be impregnated into or exchanged onto the other catalyst components, it may be done, for example, by treating the component with a metalcontaining ion. Examples of suitable platinum compounds include chloroplatinic acid, platinum (II) chloride, platinum (II) bromide and various compounds containing a platinum amine complex. Examples of tungsten compounds include ammonium metatungstate, ammonium paratungstate, and tungsten (VI) chloride. Examples of nickel compounds include nickel (II) nitrate, nickel (II) acetate, and nickel (II) carbonate. Examples of molybdenum compounds include ammonium heptamolybdate, ammonium dimolybdate, and molybdenum (III) bromide. Examples of palladium compounds include palladium (II) chloride and salts of the tetraammine palladium (II) complex. The metal compounds may be either compounds in which the metal is present in the cation of the compound and compounds in which it is present in the anion of the compound. Both types of compounds cam be used. Noble metal compounds in which the metal is in the form of a cation or a cationic complex, e.g., $Pt(NH_3)_4Cl_2$ or $Pd(NH_3)_4Cl_2$, or in the form of an anion or anionic complex, e.g., $H_2PtCl_6$, $H_2PdCl_6$ are particularly useful. Cationic forms of other metals are also very useful since they may be exchanged onto the catalyst component or impregnated into it.

The process of the invention is illustrated in the following examples along with specific methods for preparing pillared vacancy-containing titanometallate type catalysts as described previously. X-ray diffraction data was obtained by standard techniques using K-alpha doublet of copper radiation.

EXAMPLE 1

A silica-pillared titanometallate catalyst was prepared for subsequent use in the hydrocracking of a heavy petroleum fraction.

The layered precursor for the catalyst was prepared by high temperature solid state reaction of $Cs_2CO_3$ and $TiO_2$ in the stoichiometry of 1:5.2 ($Cs_{0.070}[\ ]_{0.18}Ti_{1.82}O_4$). $Cs_2CO_3$ (AESAR) was ground to a fine powder ( about 100 mesh) then dried and stored in a vacuum oven at about 180° C. $TiO_2$ was used as received. The solids (100.00 g of $Cs_2CO_3$ and 127.87 g $TiO_2$) were ground to a homogeneous mixture which was fired at about 650° C. for about 600 minutes followed by an additional 600 minutes at 650° C. after regrinding. The material was ground after firing.

An aqueous slurry of this solid (about 30% solids) was ball-milled for about 6 hours. Cesium cations were removed from 200.0 g of the ball milled solid by triple refluxing in 1M $NH_4NO_3$ with filtering and washing with hot $H_2O$ after each exchange. The resultant material was air dried after the final exchange. Analysis of this dried material indicated that 3300 ppm of $Cs^+$ remained in the sample.

The solid was then swollen by refluxing in n-octylamine (4.1 g octylamine/g solid) for 24 hours using a Dean-Stark trap in the condensation column to remove $H_2O$ from the system. After washing with 500 ml 95% solution of EtOH, the product was dried in air to yield 187.47 g of a waxy solid.

Insertion of the silica pillars was accomplished by utilizing alternate multiple treatments of tetraethylorthosilicate (TEOS) and water. The octylamine swollen product was treated with TEOS directly after octylamine treatment. The solids were stirred in TEOS (5 g TEOS/g solid), while maintaining the reaction temperature at 80° C. under a slight flow of $N_2$ (0.5 scf/h) for 24 hours. The product was filtered and air dried. The solid was slurried in water for four hours, filtered and air dried. The $H_2O$/TEOS treatments were repeated twice. A porous pillared material was obtained by calcination at 500° C. for 4 hours using a heating rate of 3° C./min.

The properties of the resultant material are set forth in the following Table 1.

TABLE 1

| Properties of the Pillared Vacancy Containing Titanometallate Catalyst | |
|---|---|
| Surface Area, $m^2/g$ | 615 |
| Density, g/cc | |
| Real | 2.700 |
| Particle | 0.979 |
| Packed | 0.863 |
| Pore Volume, cc/g | 0.651 |
| Sorption Capacities, wt % | |
| n-$C_6$, p = 40 torr | 18.8 |
| cy$C_6$, p = 40 torr | 18.7 |
| $H_2O$, p = 12 torr | 25.3 |
| Titanium, wt % | 21.7 |
| $SiO_2$, wt % | 48.0 |
| Cesium, ppm | 1750 |
| Ash, wt % | 97.5 |
| Alpha | 2.1 |

Procedures for determining the alpha value of the composition are described in U.S. Pat. No. 3,354,078 to Miale et al.; J. Catalysis, Vol. 4, p.527 (1965); J. Catalysis, Vol. 6, p 278 (1966); J. Catalysis, Vol. 61, p. 395 (1980); all f which are incorporated herein by reference. Preferably, the alpha value is determined at a fixed temperature of about 538° C. Generally, compositions used in the process of the subject invention have an alpha value of 0.5 to about 100, preferably about 1 to 50, most preferably about 1 to 20.

A ten gram sample of the pillared catalyst precursor material was then impregnated with about nine ml of an ammonium metatungstate solution containing 1.4 grams of $(NH_4)_6W_{12}O_{39}$ $H_2O$. The pillared catalyst precursor material was then dried overnight at about 110° C. and then calcined in flowing dry air at 3° C./min to 538° C. and held at this temperature for 3 hours. Thereafter, the catalyst material was cooled to room temperature and impregnated with 10 ml of a nickel nitrate solution containing 2.2 g of $Ni(NO_3)_2 6$ $H_2O$. The resultant catalyst was then dried at 110° C. overnight and calcined in flowing dry air at 3° C/min to 538° C. and held at this temperature for 3 hours. The final catalyst contained Ni and 10% W.

EXAMPLE 2

The catalyst material from Example 1 was then used in the hydrocracking of a heavy petroleum fraction. The catalyst material was charged to a reactor and, in the presence of hydrogen, used to hydrocrack Statfjord Vacuum gas oil, the properties of which are given in the following Table 2.

TABLE 2

| Properties of Statfjord Distillate | |
|---|---|
| Viscosity (SUS) | 150 |
| Distillation (D2887) | |
| 1% | 653 |
| 5% | 696 |
| 50% | 784 |
| 95% | 877 |
| 99% | 915 |
| Hydrogen, % | 13.40 |
| Nitrogen, ppm | 620 |
| Sulfur, % | 0.43 |
| Paraffins % | 30.7 |
| Mononaphthenes % | 16.9 |
| Polynaphthenes % | 17.7 |
| Aromatics % | 34.7 |
| KV 40° C., cs | 26.45 |
| KV 100° C., cs | 4.805 |
| Pour Point., °F. | 95 |
| Cloud Pt., °F. | 112 |
| Flash, COC, °F. | 421 |

The hydrocracking reaction was conducted at a pressure of about 1400 psig, a temperature in the range of 720 to 800° F and about 0.3 LHSV.

As a comparison to the subject invention, the same feedstock was hydrocracked over a catalyst known as NiW/zeolite beta under essentially identical processing conditions. The catalyst contained about 65% zeolite beta and about 35% alumina, the zeolite containing about 4% nickel and about 10 % tungsten. Catalyst NiW/zeolite beta is the subject of U.S. Pat. No. 4,612,108, incorporated herein by reference.

The results of both hydrocracking runs are graphically compared in the FIGURE of this application and illustrate the selectivity of the two catalysts for the conversion to a 330°-650° F. distillate. This FIGURE shows that the pillared vacancy titanometallate catalyst is capable of producing a higher yield of distillate than the NiW/zeolite beta catalyst. For example, at 69 wt % conversion to 650° F.−, the pillared vacancy titanometallate catalyst produced 7 wt % more 330°-650° F. distillate (33 vs 26 wt %) than the analogous NiW/zeolite beta catalyst, which is the subject of the previously mentioned patent.

The following examples illustrate additional specific sequences in which to prepare a catalyst including the layered oide of the titanometallate type intercalated with an interspathic chalcogenide as was described in general terms previously.

EXAMPLE 3 - PREPARATION OF SILICA-PILLARED TITANOZINCATE

The silica-pillared titanozincate material was prepared as follows:

$K_2CO_3$, ZnO and $TiO_2$ were thoroughly ground to form a homogeneous mixture having the stoichiometric formula $K_{0.80}(Zn_{0.40}Ti_{1.60})O_4$ which was then fired in air in a ceramic crucible at 900° C. for 200 minutes and then a 1050° C. for 720 minutes. The product was then reground and refired under the same conditions. The resulting stiff powder was then ground to about 100 mesh to yield a product analysed as $K_{0.66}(Zn_{0.35}Ti_{1.49})O_4$. The d-layer spacing from X-ray powder diffraction d(A) was measured as 7.83. Excess octylamine (5 mole equiv/mole equiv of titanozincate) was slowly added to a solution of 12% HCl (4.9 equiv HCl/mole) while keeping the temperature of the reaction mixture below 50° C. to form an acidic aqueous octylammonium chloride solution. The titanozincate was then added to the chloride solution and the mixture was heated to reflux for 24 hours. The reaction mixture was cooled, filtered and washed with hot distilled water. The air dried product was a material having the composition $$H_3O^+{}_{0.33}K_{0.03}(NH_3R^+)_{0.56}[Zn_{0.46}Ti_{1.75}]O_4$$

containing 2.68 weight percent N and having a 24.6 A d-layer spacing from the lowest two theta peak in its X-ray diffraction pattern. The formula was calculated from analytical data obtained for the materials, assuming that the $H_3O^+$ content of the interlayer can be derived by subtraction of the total cation content (alkali metal plus octylammdnium) from that required to balance the charge on the $(M,Ti)_2O_4^{n-}$ layers due to incorporation of the transition metal cation. A low $H^+$ concentration was maintained during octylammonium exchange to avoid decomposition of the metallotitanate structure.

The octylammonium-exchanged product was then stirred in EtOH for 2 hours, filtered, and air dried at room temperature for 2 hours. The product was then slurried with $H_2O$ using a blender to ensure maximum mixing of the hydrophobic solid with water. The slurry was then transferred to a beaker and stirred overnight. The mixture was filtered and air dried for 4 hours.

The resulting filter cake was treated with tetraethylorthosilicate (TEOS) (5 g TEOS/g solid) for 72 hours. The pillared material was obtained by filtering this slurry and drying the solid in air. Calcination of the pillared material at 500° C. for about 4 hours in air eliminated octylamine and produced a silica-pillared titanozincate.

EXAMPLE 4 - PREPARATION OF A SILICA-PILLARED TITANOGALLATE

(a) Solid State Preparation of Precursor $Ga_2O_3$ (25.00 g, 0.133 mole), $TiO_2$ (31.95 g, 0.399 mole), and $Cs_2CO_3$ (43.43 g, 0.133 mile) were thoroughly mixed and ground to a homogeneous mixture. The mixture was fired at 910° C. for 12 h after heating to 150° C. for 2 h and 500° C. for 4 h to decompose the reactants. Temperature ramps of 5° C./min were used. After firing, the product was cooled and ground. The x-ray powder diffraction pattern indicated that the product was a mixture of a layered phase previously observed and an additional material, possibly beta-$Ga_2O_3$. Analysis of the material gave the following composition: 34%Cs, 24.4% Ga, 20.3% Ti, 99.07% ash.

(b) Swelling with Octylammonium Ion

Concentrated HCl (66.65 g, 0.6912 mole) was diluted to 250 ml with $H_2O$. Octylamine (91.04 g, 0.7052 mole) was added slowly. Forty grams of the sample from (a) were added and the solution was heated to reflux with stirring for 48 h. The solution was filtered, washed with 1500 ml hot $H_2O$ and dried in air. The powder x-ray diffraction pattern from 2°–20° 2 theta was obtained and indicated a d-spacing of 23.2 A in the solid.

This material (45.0 g) was stirred in 150 ml EtOH for 2 h, filtered, and air dried. The air dried sample was slurried in 300 ml $H_2O$ using a blender to ensure complete wetting of the hydrophobic solid. The slurry was transferred to a beaker and stirred overnight, then filtered and air dried.

(c) Treatment with Tetraethylorthosilicate (TEOS)

The solid from (b) was reslurried in 700 ml $H_2O$ for 2 h, filtered and air dried immediately prior to treatment with TEOS to ensure that the interlaminar water was present. The solid (36.94 g) was stirred in 185.0 g TEOS at 80° C for 24 h. The reaction was carried out under an $N_2$ environment to control the humidity. The reaction mixture was filtered and the solid dried in air to yield 39.66 g (7.4% weight uptake). The process was repeated; however, no weight gain was observed on the second treatment of this sample.

(d) Calcination to Produce a Molecular Sieve

The final product was obtained by calcining the sample at 500° C. in $N_2$ for 1 h followed by 2 h in air. A 20.5% weight loss was observed during the final calcination. A powder x-ray diffraction pattern of the material showed a low angle at 3.9° 2 theta, indicating a basal spacing of 22.83 A and an interlayer separation of about 15.8 A assuming no degradation of the layer structure upon calcination. Chemical analysis of the material indicated the following composition: 9.47% Ga, 26.5% $SiO_2$, 21.3% Ti, 0.34% Cs, 98.00% ash. The porous solid had a surface area of $266m^2/g$ and absorbed 12.0 wt % $H_2O$, 8.2 wt % cyclohexane and 7.3 wt % n-hexane.

EXAMPLE 5 - PILLARING OF VACANCY TITANATE

In this example, the layered starting material was a titanate having the empirical formula $Cs_{0.7}Ti_{1.82}O_4$. This material contains vacancies at certain titanium sites in the layers and so can be described by the general formula $Cs_{4y}([\ ]_yTi_{2-y})O_4$ wherein [ ] is a vacancy site and y is 0.18.

The layered vacancy titanate was prepared by the high temperature solid state reaction of $Cs_2CO_3$ and $TiO_2$ in the stoichiometry of 1:5.2. The $Cs_2CO_3$ employed was ground to fine powder (less than 100 mesh) dried and stored in a vacuum oven at 180° C. The $TiO_2$ employed was used as received. The solids (50g $Cs_2CO_3$ and 63.93g $TiO_2$) were ground to an homogenous mixture which was fired at 650° C. for 10 hours and, after regrinding, was then fired at 950° C. for a further 10 hours. The resultant product was then ground.

30 g of the titanate product was then swollen by refluxing with octylamine/HCl (mole ratio 1 titanate: 5 octylamine:4.9HCl) for 14 hours. After washing with 1000 ml of water, the product was dried in air overnight.

25 g of the swelled titanate was stirred in 300 ml ethanol, filtered and air dried. The dried solid was then slurried in 500 ml water for 24 hours, pillared and air dried overnight. The resultant solid (16.4g) was stirred with 100 g of TEOS for 24 hours and the mixture was filtered and air dried to yield 18.5 g of solid product. The required porous molecular sieve was obtained by calcining the product in air at 500° C. for 4 hours.

While there has been shown and described what is considered to be preferred embodiments of the present invention, it will be apparent to those skilled in the art that various changes and modifications may be made herein without departing from the invention as defined in the appended claims.

It is claimed:

1. A process for hydrocracking a petroleum fraction to lighter hydrocarbons comprising providing a feedstock containing a relatively heavy petroleum fraction and contacting said feedstock with a catalyst in the presence of hydrogen under hydrocracking conditions including an elevated temperature, the catalyst composition including titanometallate layered metal oxide material comprising a layered metal oxide and pillars of a chalcogenide of at least one element selected from Groups IB, IIB, IIIA, IIIB, IVB, VA, VB, VIA, VIIA and VIIIA of the Periodic Table of the Elements separating the layers of the metal oxide, wherein each layer of the metal oxide has the general formula $$[M_x[\ ]_y{}^{z2-(x+y)}O_4]^{q-}$$

wherein M is at least one metal of valance n wherein n is an integer between 0 and 7, [ ] represents a vacancy site, Z is a tetravalent titanium metal, and wherein $q=4y-x(n--4)$ $O<x+y<2$ and (b) at least one hydrogenating metal selected from Groups IVA, VIA and VIIIA.

2. The process of claim 1, wherein n is 2.

3. The process of claim 1, wherein n is 3.

4. The process of claim 1, wherein y is greater than zero.

5. The process of claim 1, wherein q is from 0.6–0.9.

6. The process of claim 1, wherein M is selected from the group consisting of Mg, Sc, Mn, Fe, Cr, Ni, Cu, Zn, In, Ga and Al.

7. The process of claim 5, wherein M is selected from the group consisting of Ga and In.

8. The process of claim 5, wherein M is selected from the group consisting of Fe, Ni and Zn.

9. The process of claim 1, wherein the pillars comprise a polymeric oxide.

10. The process of claim 1, wherein the pillars comprise polymeric silica.

11. The process of claim 1, wherein said catalyst composition further contains a porous crystalline silicate material having a Constraint Index of less than about 2.

12. The process of claim 11, wherein said Constraint Index is less than about 1.

13. The process of claim 11, wherein said composition contains between about 10 to 20 weight percent of said titanometallate layered metal oxide and up to about 80 weight percent of said porous crystalline silicate material.

14. The process of claim 10, wherein said polymeric oxide comprises polymeric silica and polymeric alumina.

15. The process of claim 10, wherein said polymeric oxide comprises polymeric silica and polymeric titania.

16. The process of claim 11, wherein said porous crystalline silicate material has a structure selected from the group consisting of ZSM-4, ZSM-12, ZSM-18, ZSM-20, ZSM-50 and zeolite beta.

17. The process of claim 11, wherein said porous crystalline silicate material has a structure selected from the group consisting of Zeolites X, Y, L, REY, USY, UHP-Y L-210-T, LZ-210A, LZ-210-A, LZ-210-M, LZ-210; Mordenite, and TEA Mordenite.

18. The process of claim 17, wherein said porous crystalline silicate material has the structure of zeolite beta.

19. The process of claim 18, wherein M is Ga and said intespathic polymeric chalcogenide is polymeric silica.

20. The process of claim 18, wherein M is Zn and said pillars comprise polymeric silica.

21. The process of claim 20, wherein said titanometallate layered metal oxide comprises at least about 15 weight percent of said catalyst composition and said porous shape-selective crystalline silicate material comprises at least about 60 weight percent of said composition.

22. The process of claim 1, wherein said composition comprises an inorganic oxide binder.

23. The process of claim 22, wherein said binder is alumina.

24. The process of claim 22, wherein said binder is silica-alumina.

25. The process of claim 1, wherein the hydrocracking conditions include a temperature from about 360° C. to about 440° C.

26. The process of claim 25, wherein the hydrocracking conditions include a pressure of about 420 psig to about 2160 psig.

27. The process of claim 26, wherein the hydrocracking conditions include a liquid hourly space velocity of about 0.1 to about 10.

28. The process of claim 27, wherein the feedstock includes vacuum gas oils.

29. The process of claim 27, wherein the feedstock includes deasphalted resids.

30. The process of claim 1, wherein the feedstock includes vacuum gas oil.

31. The process of claim 1, wherein the feedstock includes deasphalted resids.

32. The process of claim 1, wherein x is zero.

33. The process of claim 4, wherein y is greater than 0.1.

34. The process of claim 10, wherein said feedstock is a vacuum gas oil, x is zero, y is greater than 0.1, and said hydrogenating metal is Ni and W.

* * * * *